US011211188B2

(12) United States Patent
Nagai et al.

(10) Patent No.: US 11,211,188 B2
(45) Date of Patent: Dec. 28, 2021

(54) MULTILAYER COIL COMPONENT

(71) Applicant: TDK CORPORATION, Tokyo (JP)

(72) Inventors: Yusuke Nagai, Tokyo (JP); Takashi Suzuki, Tokyo (JP); Hidekazu Sato, Tokyo (JP); Takashi Endo, Tokyo (JP); Kouichi Kakuda, Tokyo (JP); Kunihiko Kawasaki, Tokyo (JP); Shinichi Kondo, Tokyo (JP); Yuya Ishima, Tokyo (JP); Shinichi Sato, Tokyo (JP); Masaki Takahashi, Tokyo (JP)

(73) Assignee: TDK CORPORATION, Tokyo (JP)

( * ) Notice: Subject to any disclaimer, the term of this patent is extended or adjusted under 35 U.S.C. 154(b) by 194 days.

(21) Appl. No.: 16/136,944

(22) Filed: Sep. 20, 2018

(65) Prior Publication Data

US 2019/0096561 A1 Mar. 28, 2019

(30) Foreign Application Priority Data

Sep. 25, 2017 (JP) ..... JP2017-183980

(51) Int. Cl.
*H01F 17/00* (2006.01)
*H01F 17/04* (2006.01)
(Continued)

(52) U.S. Cl.
CPC ..... *H01F 17/0013* (2013.01); *H01F 17/04* (2013.01); *H01F 27/34* (2013.01);
(Continued)

(58) Field of Classification Search
CPC ..... H01F 17/0013; H01F 17/04
See application file for complete search history.

(56) References Cited

U.S. PATENT DOCUMENTS

2001/0032383 A1* 10/2001 Haratani ..... H01G 4/30 29/25.42
2002/0008606 A1* 1/2002 Okuyama ..... H01F 41/043 336/200

(Continued)

FOREIGN PATENT DOCUMENTS

CN 106373711 A 2/2017
CN 106816266 A 6/2017

(Continued)

*Primary Examiner* — Elvin G Enad
*Assistant Examiner* — Malcolm Barnes
(74) *Attorney, Agent, or Firm* — Oliff PLC

(57) ABSTRACT

In a stepwise structure formed in a multilayer coil component, a difference occurs in a shrinkage amount between a maximum film thickness portion in which the number of layers is large and a minimum film thickness portion in which the number of layers is small due to portions different in the number of layers of coil parts (that is, upper coil part, lower coil part, and connecting part) adjacent to each other like the maximum film thickness portion and the minimum film thickness portion, readily causing a crack by an inner stress due to the difference in the shrinkage amount. In a multilayer coil component according to the present disclosure, a stress relaxation part overlapping with a maximum film thickness portion whose shrinkage amount is large is provided to relax inner stress in a stepwise structure, resulting in prevention of a crack.

4 Claims, 9 Drawing Sheets

(51) Int. Cl.
*H01F 27/34* (2006.01)
*H01F 41/04* (2006.01)
*H01F 27/29* (2006.01)

(52) U.S. Cl.
CPC ..... *H01F 41/041* (2013.01); *H01F 27/292* (2013.01); *H01F 2017/004* (2013.01); *H01F 2017/048* (2013.01)

(56) References Cited

U.S. PATENT DOCUMENTS

2008/0246579 A1* 10/2008 Mizuno ..... H01F 17/0013 336/205
2010/0033286 A1* 2/2010 Katayama ..... B32B 18/00 336/200
2010/0194513 A1* 8/2010 Ozawa ..... H05K 1/165 336/200
2013/0234285 A1* 9/2013 Hijioka ..... H01L 28/10 257/531
2013/0314193 A1* 11/2013 Lee ..... H01F 5/00 336/200
2014/0145815 A1* 5/2014 Ishii ..... H01F 27/292 336/200
2015/0014042 A1* 1/2015 Noguchi ..... H05K 1/165 174/262
2017/0025219 A1 1/2017 Nagai et al.
2017/0103845 A1 4/2017 Nagai et al.
2017/0287620 A1* 10/2017 Miyoshi ..... H01F 41/041
2017/0352467 A1* 12/2017 Kakiuchi ..... H01F 27/2804
2018/0096778 A1* 4/2018 Yatabe ..... H01G 4/40

FOREIGN PATENT DOCUMENTS

JP 06181122 A * 6/1994
JP 2010192715 A * 9/2010
JP 2017-059749 A 3/2017
JP 2017-073495 A 4/2017
KR 10-2009-0026318 A 3/2009
KR 20130019195 A * 2/2013
KR 10-2017-0012074 A 2/2017
TW I590267 B 7/2017

* cited by examiner

MULTILAYER COIL COMPONENT

CROSS-REFERENCE TO RELATED APPLICATIONS

This application is based upon and claims the benefit of priority from Japanese Patent Application No. 2017-183980, filed on 25 Sep. 2017, the entire contents of which are incorporated herein by reference.

TECHNICAL FIELD

The present disclosure relates to a multilayer coil component.

BACKGROUND

Conventionally, a multilayer coil component has been known in which inner conductors having a layer shape and forming a part of a coil are laminated in an element body. Japanese Unexamined Patent Publication No. 2017-59749 (Patent Literature 1) discloses a multilayer coil component in which a stress relaxation part is provided to be in contact with a surface of an inner conductor.

SUMMARY

In the multilayer coil component according to the above-described conventional technique, the inner conductor is even in its length related to a laminated direction (i.e. thickness), so that a shrinkage amount of the inner conductor due to change of heat environment (e.g., firing during manufacture of components) is also substantially even.

The inventors have continued to study about a structure of a coil having stepwise structure in which inner conductors are overlapped with each other in a stepwise manner and have acquired a knowledge that, in such a structure, there exists a thickness difference occurs between a portion where the inner conductors are overlapped and a portion where the inner conductors not overlapped, so that a crack is readily occurred in the element body near a portion where there is such a thickness difference in the inner conductors. The inventors have newly found, as a result of intensive studies, a technique capable of preventing occurrence of a crack even when the coil has a stepwise structure.

The present disclosure provides a multilayer coil component capable of preventing occurrence of a crack even when a coil has a stepwise structure.

A multilayer coil component according to an embodiment of the present disclosure has a laminated structure and includes a coil in an insulating element body, the multilayer coil component including a plurality of coil parts forming a part of the coil and extending in the plurality of layers that form the laminated structure, wherein the coil has a stepwise structure, the coil parts adjacent to each other in a laminated direction are overlapped with each other in a stepwise manner in the stepwise structure, there exist a first portion and second portion in the stepwise structure, two or more of the coil parts are overlapped as layers in the first portion, the second portion adjacent to the first portion in a direction perpendicular to the laminated direction, the second portion having the number of layers smaller than the number of the layers of the first portion, and a stress relaxation part overlapped with at least the first portion among the first portion and the second portion is provided.

The inventors have acquired a knowledge that, in a stepwise structure, a difference occurs in a shrinkage amount between a portion where the number of layers is large and a portion where the number of layers is small due to portions different in the number of layers of coil parts adjacent to each other, so that a crack is readily occurred by inner stress due to the difference of the shrinkage amount. Therefore, the inventors have found a technique for relaxing inner stress by providing a stress relaxation part overlapping with a portion where shrinkage amount is large. That is, the above multilayer coil component relaxes inner stress in the stepwise structure by the stress relaxation part overlapping with the first portion where the number of layers is large, making it possible to prevent occurrence of crack.

A multilayer coil component according to another embodiment is provided with the stress relaxation part overlapping only with the first portion among the first portion and the second portion. The stress relaxation part exerts a high stress relaxation effect at the first portion. This makes it possible to relax inner stress sufficient for practical use while reducing a formation area of the stress relaxation part by not providing the stress relaxation part on the second portion, making it possible to prevent occurrence of the crack efficiently.

In a multilayer coil component according to another embodiment, the coil has a plurality of turns, and the stress relaxation part is provided on only one of a pair of the turns adjacent to each other in the laminated direction. A crack that may be occurred between the pair of the turns adjacent to each other in the laminated direction can be prevented by providing the stress relaxation part only on one of the pair of the turns.

DETAILED DESCRIPTION

Figure 1:
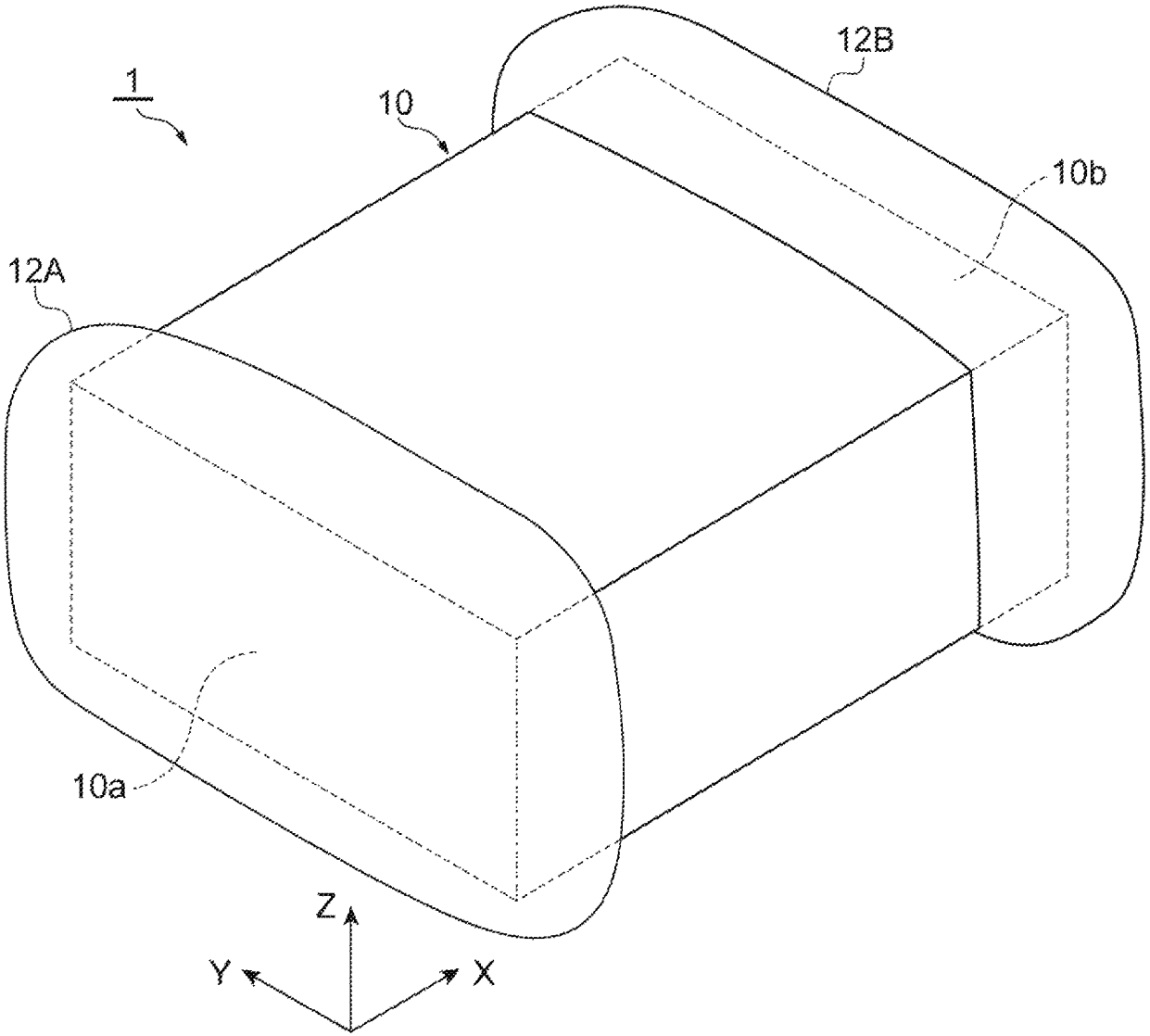
FIG. 1 is a schematic perspective view illustrating a multilayer coil component according to an embodiment.

Hereinafter, an embodiment of the present disclosure will be described in detail with reference to the accompanying drawings. Note that same reference numerals are used to denote the same elements, and their overlapped description will be omitted.

First, the overall structure of a multilayer coil component 1 according to the embodiment will be described with reference to FIGS. 1, 2.

Figure 2:
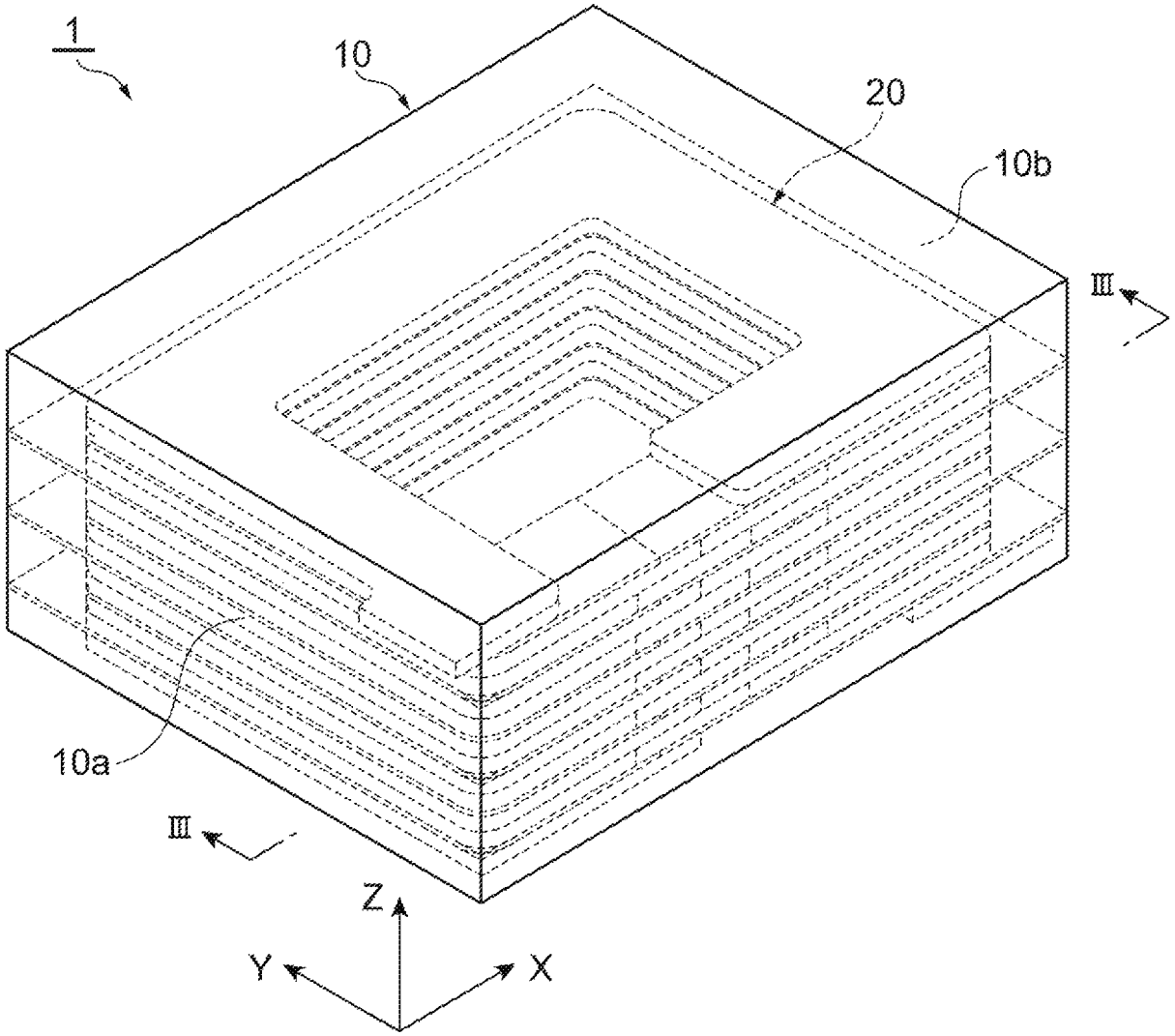
FIG. 2 is a schematic perspective view illustrating an inner structure of an insulating element body of the multilayer coil component illustrated in FIG. 1.

As illustrated in FIG. 1, the multilayer coil component 1 is formed of an insulating element body 10 having an outer shape of a substantially rectangular parallelepiped shape, and a coil 20 formed inside the insulating element body 10. The multilayer coil component 1 has a laminated structure including layers L1 to L20 as shown in FIG. 2. Note that, external terminal electrodes 12A, 12B are respectively provided on a pair of opposed end faces 10*a*, 10*b* of the insulating element body 10. As an example, the multilayer coil component 1 is designed to be 2.0 mm in the long side, 1.6 mm in the short side, and 0.9 mm in the height.

For convenience of description, XYZ coordinates are set as illustrated in the drawings. That is, a laminated direction of the multilayer coil component 1 is set as Z direction, an opposing direction of the end faces 10*a*, 10*b* on which the external terminal electrodes 12A, 12B are respectively provided is set as X direction, and a direction perpendicular to Z direction and X direction is set as Y direction.

The insulating element body 10 has insulation properties and is composed of an insulation-coated granular magnetic material. As the magnetic material, a metal magnetic material (Fe, FE—Si—Cr, Fe—Ni—Si, Fe—Ni—Si—Co, Fe—Si—Al alloy, or the like) can be employed. Among layers L1 to L20 forming the multilayer coil component 1, the cover layers that are the uppermost layer L1 and the lowermost layer L20 is wholly composed of the above-mentioned magnetic material. The other layers L2 to L19 are also composed of the above-mentioned magnetic material except a coil part and a stress relaxation part 40 described below.

The coil 20 is formed of a plurality of coil parts included in respective the layers L2 to L19 excluding the uppermost layer L1 and lowermost layer L20. Each coil part has a layer shape extending in a layer direction (X-Y plane direction) perpendicular to the laminated direction (Z direction) in the layers L1 to L20 forming the coil 20. Each coil part is a conductive layer forming a part of the coil 20. A metal such as Ag, Cu, Au, Al, or Pd, a Pd/Ag alloy, or the like can be used for the material of the conductive layer. A Ti compound, a Zr compound, a Si compound, or the like may be added to the conductive layer. Such a conductive layer can be formed by a printing method or a thin film growing method.

Figure 3:
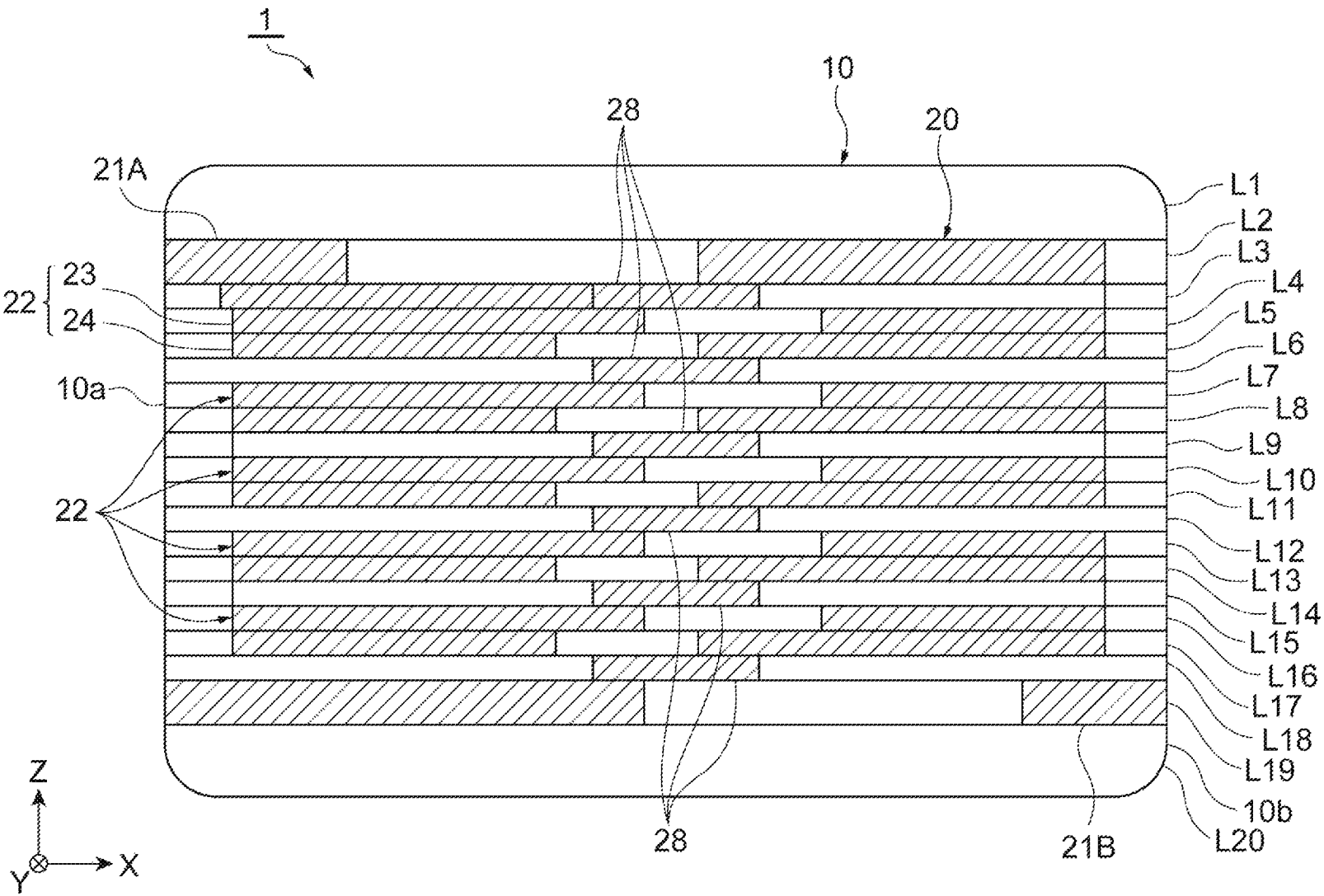
FIG. 3 is a cross sectional view taken along line III-III of the insulating element body illustrated in FIG. 2.

As shown in FIG. 3, the coil 20 includes, as a coil part forming the coil 20, a lead-out electrode 21A extended to one end face 10*a* on which the external terminal electrode 12A is provided, and a lead-out electrode 21B extended to the other end face 10*b* on which the external terminal electrode 12B is provided.

Figure 4:
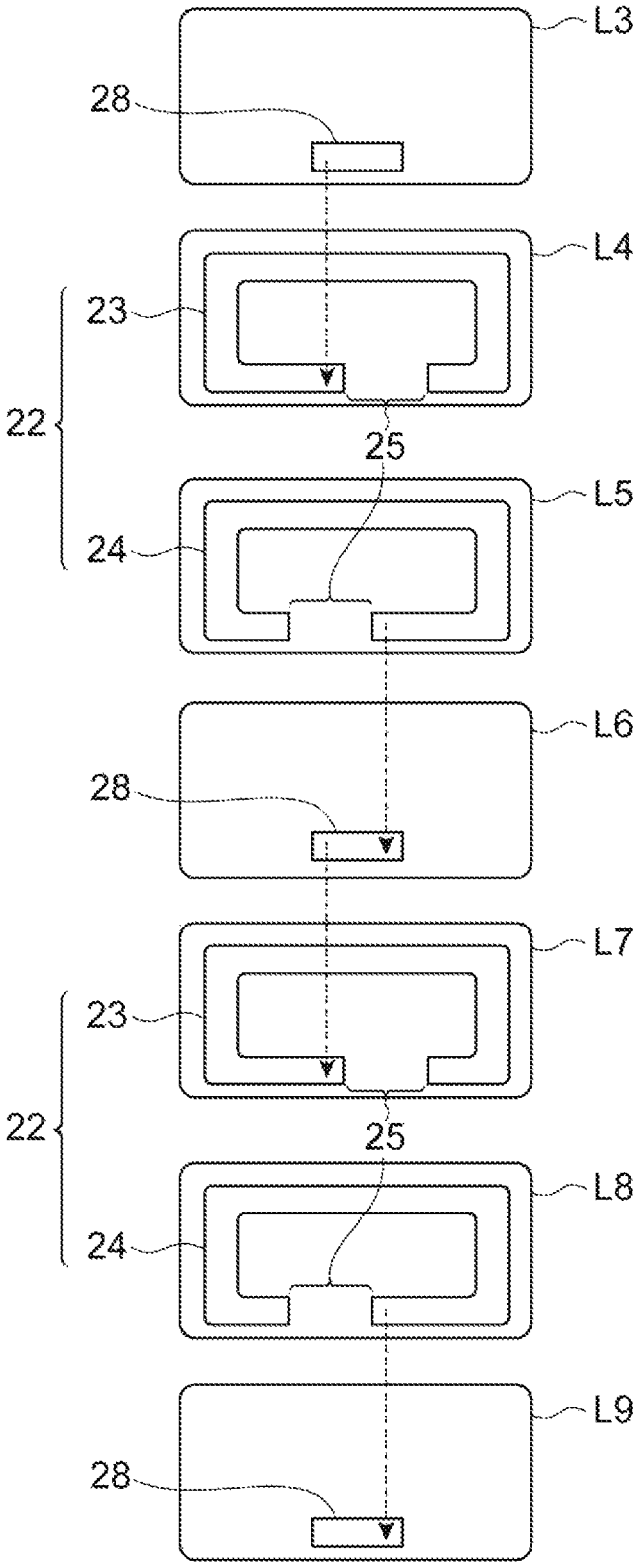
FIG. 4 is a diagram illustrating parts of a layer configuration of the multilayer coil component illustrated in FIG. 1.

The coil 20 also includes a plurality of coil conductive parts 22 each forming one turn of the coil as illustrated in FIGS. 3 and 4. Each coil conductive part 22 is formed of two layers that are an upper coil part 23 and a lower coil part 24 that are the coil parts forming the coil 20. Each coil conductive part 22 has a substantially annular shape having a divided portion 25 as a part thereof when viewed from the laminated direction, and may have a c character shape as illustrated in FIG. 4. Each coil conductive part 22 has a pair of ends formed of a first end 22*a* and a second end 22*b* sandwiching the divided portion 25 and opposing to each other via the divided portion 25.

However, a position of the divided portion 25 in the upper coil part 23 and a position of the divided portion 25 in the lower coil part 24 are deviated in the opposing direction of the first end 22*a* and the second end 22*b* (that is, X direction). Accordingly, the coil conductive part 22 has a one-layer structure in which the upper coil part 23 and the lower coil part 24 are not overlapped near the divided portions 25, and has a two-layers structure in which the upper coil part 23 and the lower coil part 24 are overlapped except a vicinity of the divided portions 25.

The coil 20 also includes a connecting part 28 for connecting the coil conductive parts 22 with each other as a coil part forming the coil 20. In the embodiment, the coil conductive parts 22 having the same shape and the connecting parts 28 having the same shape are alternately aligned in the laminated direction. The connecting part 28 is arranged at the position corresponding to the position of the divided portion 25 of the coil conductive part 22, and has a rectangular shape extending along the opposing direction of the pair of ends 22*a*, 22*b* of the coil conductive part 22 (that is, along the shape of the divided portion 25).

The connecting part 28 connects the coil conductive parts 22 adjacent to each other in the up and down in the laminated direction. To be more specific, the connecting part 28 overlaps with the lower coil part 24 of the coil conductive part 22 located on its upper side in a stepwise manner and overlaps the upper coil part 23 of the coil conductive part 22 located on its lower side in a stepwise manner. This forms a stepwise structure around the connecting part 28.

Figure 5:
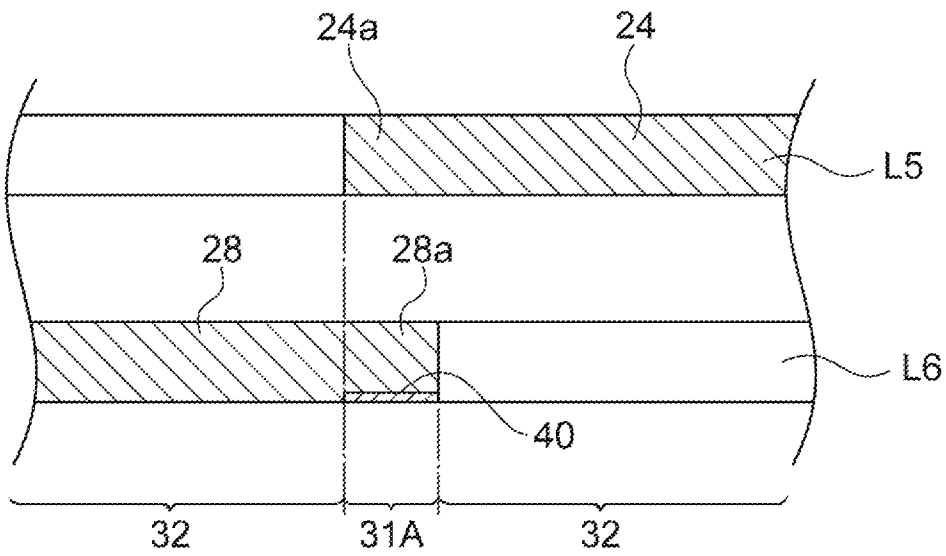
FIG. 5 is a diagram illustrating a positional relationship between a lower coil part and a connecting part of the multilayer coil component illustrated in FIG. 1.
Figure 6:
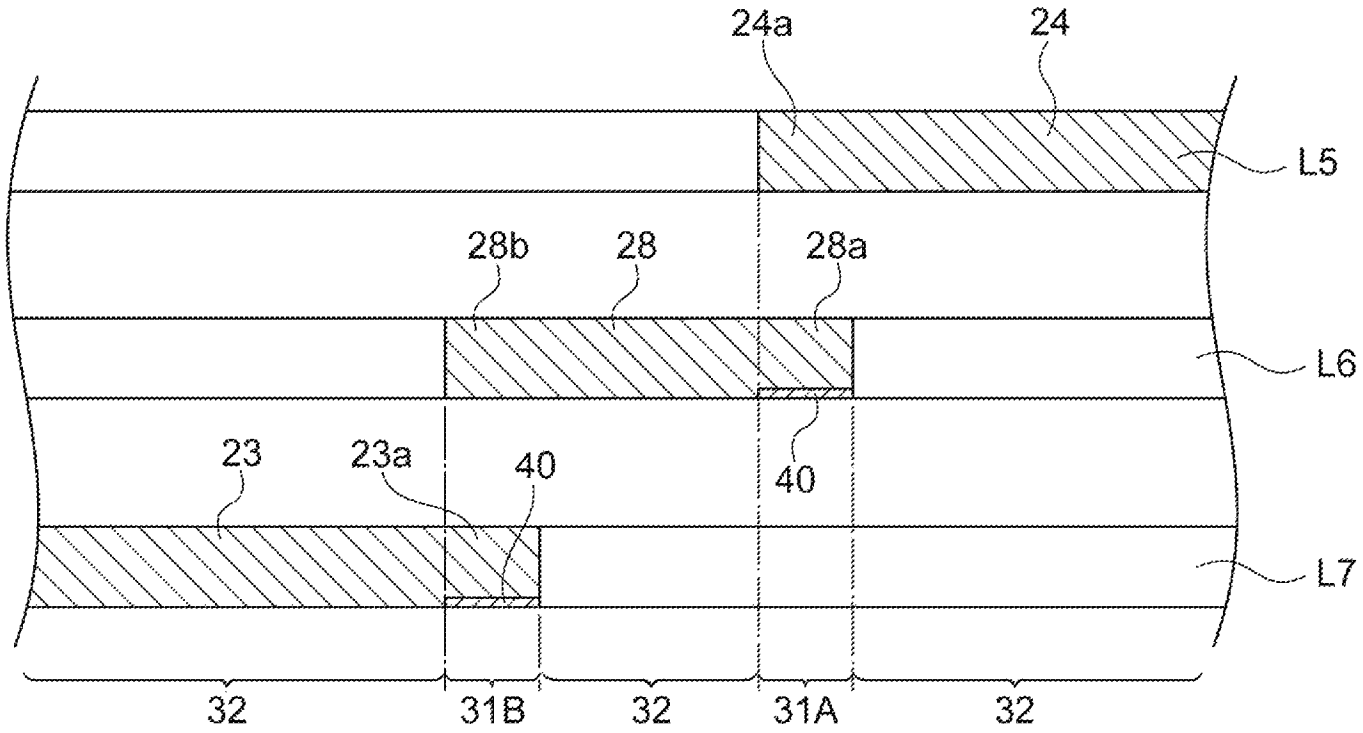
FIG. 6 is a diagram illustrating a positional relation of an upper coil part, the lower coil part, and the connecting part of the multilayer coil component illustrated in FIG. 1.

Hereinafter, the stepwise structure around the connecting part 28 will be descried with reference to FIG. 5 and FIG. 6. FIG. 5 is a diagram illustrating a structure of the lower coil part 24 and the connecting part 28 in a vertical cross section (X-Z cross section) parallel to the opposing direction (X direction) in which the pair of ends 22*a*, 22*b* of the coil conductive parts 22 are opposed. FIG. 6 is a diagram illustrating a structure of the lower coil part 24, the connecting part 28, and the upper coil part 23 in the above-mentioned vertical cross section (X-Z cross section).

As illustrated in FIG. 5, the lower coil part 24 positioned just above the connecting part 28 in the laminated direction is overlapped with one end 28*a* of the connecting part 28 at its end 24*a* to form a stepwise structure. In the stepwise structure, a maximum film thickness portion (first portion) 31A is formed having a two-layers structure in which the end 24*a* of the lower coil part 24 and the end 28*a* of the connecting part 28 are overlapped. Furthermore, on both ends of the maximum film thickness portion 31A, a minimum film thickness portion 32 (second portion) having a one-layer structure of the lower coil part 24 or the connecting part 28 is formed to be adjacent to each other in the X-Y plane direction (X direction in the embodiment). Then, the stress relaxation part 40 is formed on a lower surface of the end 28*a* of the connecting part 28 corresponding to the maximum film thickness portion 31.

The stress relaxation part 40 is a space in which powder exists, and is in contact with the lower surface of the end 28*a* of the connecting part 28. The stress relaxation part 40 relaxes inner stress occurred in the insulating element body 10 by being interposed between an element body area of the insulating element body 10 and the coil part. The powder in the space of the stress relaxation part 40 is, for example, $ZrO_2$ powder. The melting point of $ZrO_2$ is, for example, not less than about 2700° C., and is considerably higher than the firing temperature of the metal magnetic material. The average particle diameter of the powder is, for example, not more than 0.1 μm.

Furthermore, as illustrated in FIG. 6, also in the upper coil part 23 positioned just below the connecting part 28 in the laminated direction, its end 23*a* is overlapped with the other end 28*b* of the connecting part 28 to form a stepwise structure, so that a maximum film thickness portion 31B is formed having a two-layers structure in which the end 23*a* of the upper coil part 23 and the end 28*b* of the connecting part 28 are overlapped. Furthermore, on the both ends of the maximum film thickness portion 31B, the minimum film thickness portion 32 having a one-layer structure of the upper coil part 23 or the connecting part 28 is formed so as to be adjacent to each other in the X-Y plane direction (X direction in the embodiment). The above-described stress relaxation part 40 is provided also on the lower surface of the end 23*a* of the upper coil part 23 corresponding to the maximum film thickness portion 31B.

Figure 7:
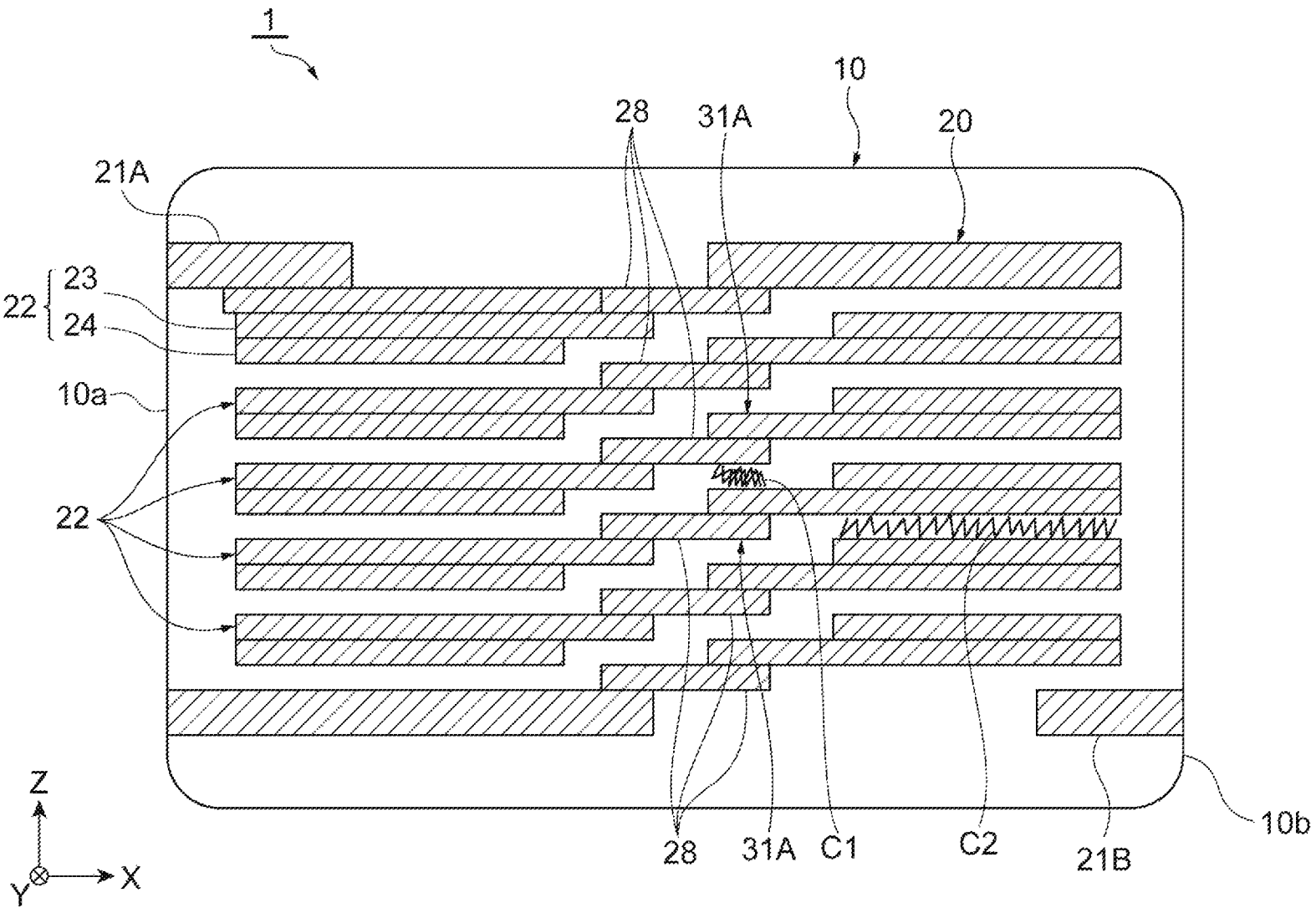
FIG. 7 is a diagram illustrating a condition in which a crack is occurred in the multilayer coil component.

The inventors have acquired a knowledge that, in the stepwise structure as illustrated in FIG. 5 and FIG. 6, a difference occurs in a shrinkage amount between the maximum film thickness portions 31A, 31B in which the number of layers is large and the minimum film thickness portions 32 in which the number of layers is small due to portions different in the number of layers of the coil parts (that is, upper coil part 23, lower coil part 24, connecting part 28) adjacent to each other like the maximum film thickness portions 31A, 31B and the minimum film thickness portions 32, so that a crack is readily occurred by inner stress due to the difference of the shrinkage amount. In this case, as illustrated in FIG. 7, a crack C1 probably occurs, for example, between the maximum film thickness portions 31A adjacent vertically to each other in the laminated direction or on the insulating element body 10 near the place. Therefore, in the above-mentioned multilayer coil component 1, the stress relaxation part 40 overlapped with the maximum film thickness portions 31A, 31B having a large shrinkage amount is provided to relax inner stress in the stepwise structure, thus preventing occurrence of crack C1.

Note that, the stress relaxation part 40 may be filled with powder in its entirety, or a gap or the like may be formed between powders. That is, the powder may densely exist in the stress relaxation part 40 to be in contact with the coil part or the element body, or may exist to have a gap between with at least one of the coil parts 23, 24, 28 and the insulating element body 10. The gap or the like is formed due to, for example, disappearance of an organic solvent or the like included in the material for forming the stress relaxation part 40 during firing.

The stress relaxation part 40 can be formed by a known method. As an example, the stress relaxation part 40 can be formed by forming a powder pattern corresponding to the stress relaxation part 40 before forming conductive patterns corresponding to the coil parts 23, 24, and 28 on a green sheet that should be the insulating element body 10. Specifically, applying a paste such as $ZrO_2$ on the above-mentioned green sheet by a screen printing or the like makes it possible to form a powder pattern that should be the stress relaxation part 40 after firing. The paste such as $ZrO_2$ can be obtained by mixing $ZrO_2$ powder, organic solvent, organic binder, and the like. Subsequently, by applying the above-mentioned conductive paste on the powder pattern formed on the green sheet by a screen printing or the like, conductive patterns that should be the coil parts 23, 24, 28 after firing are formed. The conductive paste can be manufactured by mixing conductive powder, organic solvent, organic binder, and the like. The conductive patterns are sintered by a predetermined firing treatment to become the coil parts 23, 24, 28. The powder pattern becomes the stress relaxation part 40 in which powder exists by firing. The powder exists in the stress relaxation part 40 has substantially the same average grain diameter as that of $ZrO_2$ powder used for forming the powder pattern before firing.

Note that, besides the aspect in which the stress relaxation part 40 is provided only on the maximum film thickness portion 31A, 31B among the maximum film thickness portion 31A, 31B and the minimum film thickness portion 32 adjacent to each other in the laminated direction, an aspect may be employed in which the stress relaxation part 40 is provided on both the maximum film thickness portion 31A, 31B and the minimum film thickness portion 32. Also in this case, inner stress in the stepwise structure of the multilayer coil component 1 is relaxed to prevent occurrence of the crack C1. However, the stress relaxation part 40 exerts a high stress relaxation effect in the maximum film thickness portions 31A, 31B. This makes it possible to relax inner stress sufficient for practical use while reducing the formation area of the stress relaxation part 40 by not providing the stress relaxation part 40 on the minimum film thickness portion 32, making it possible to prevent occurrence of the crack C1 efficiently.

Figure 8:
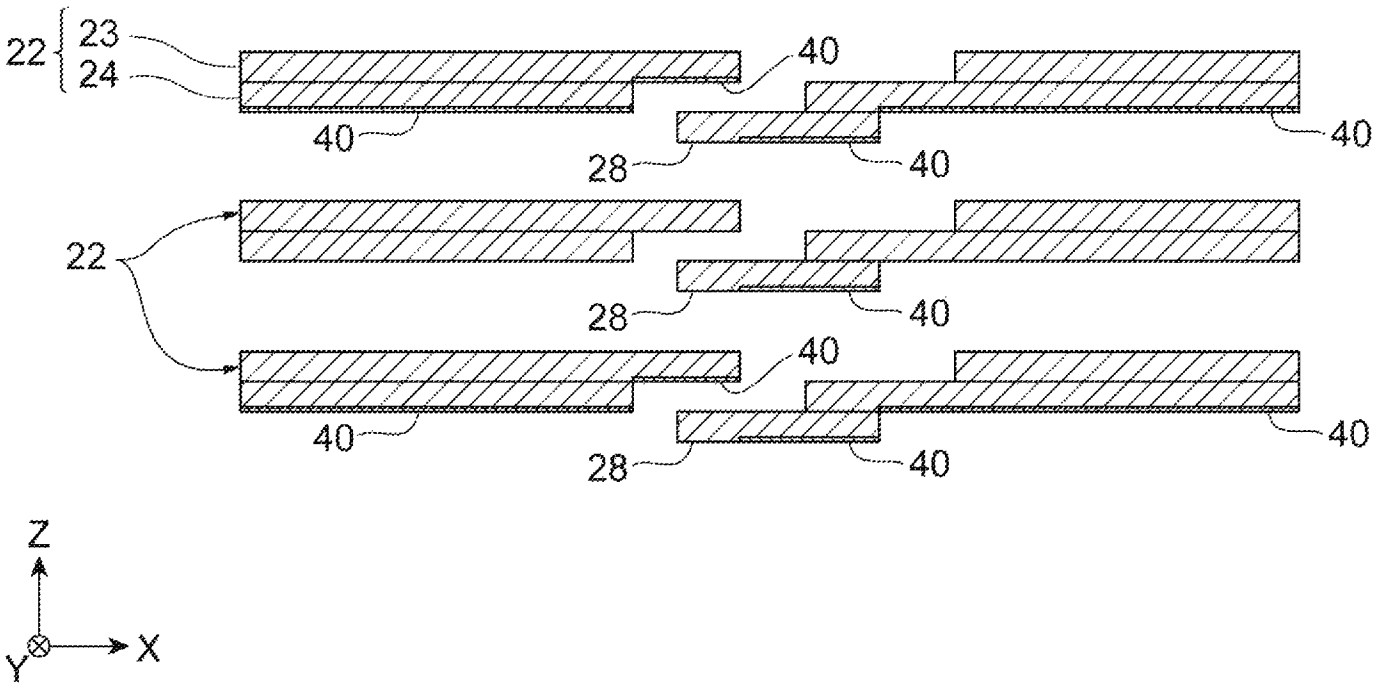
FIG. 8 is a diagram illustrating a multilayer coil component of another aspect.

The stress relaxation part 40 can be wholly provided on the lower surface of the coil conductive part 22 forming one turn of the coil (that is, lower surface of the lower coil part 24). In this case, as illustrated in FIG. 7, for example, a crack C2 that may be occurred on the insulating element body 10 between the coil conductive parts 22 adjacent vertically to each other in the laminated direction (that is, between turns of the coil 20) can be prevented. The crack C2 that may be occurred between the pair of coil conductive parts 22 can be prevented by providing the stress relaxation part 40 only on one of the pair of coil conductive parts 22 adjacent to each other in the laminated direction as illustrated in FIG. 8. Note that, in FIG. 8, a structure is illustrated in which the coil conductive part 22 in which the stress relaxation part 40 is provided on its lower surface and the coil conductive part 22 in which no stress relaxation part 40 is provided on its lower surface are alternately laminated. A structure may be employed in which the coil conductive part 22 on which the stress relaxation part 40 is provided on its lower surface is arranged for every two layers or every three layers, or a structure may be employed in which the coil conductive part 22 on which the stress relaxation part 40 is provided on its lower surface is arranged at only a center portion in the laminated direction.

One embodiment of the present disclosure is described above, but the present disclosure is not limited to the above embodiment, and may be modified or may be used for another application in a range without changing the gist described in each of the claims.

Figure 9:
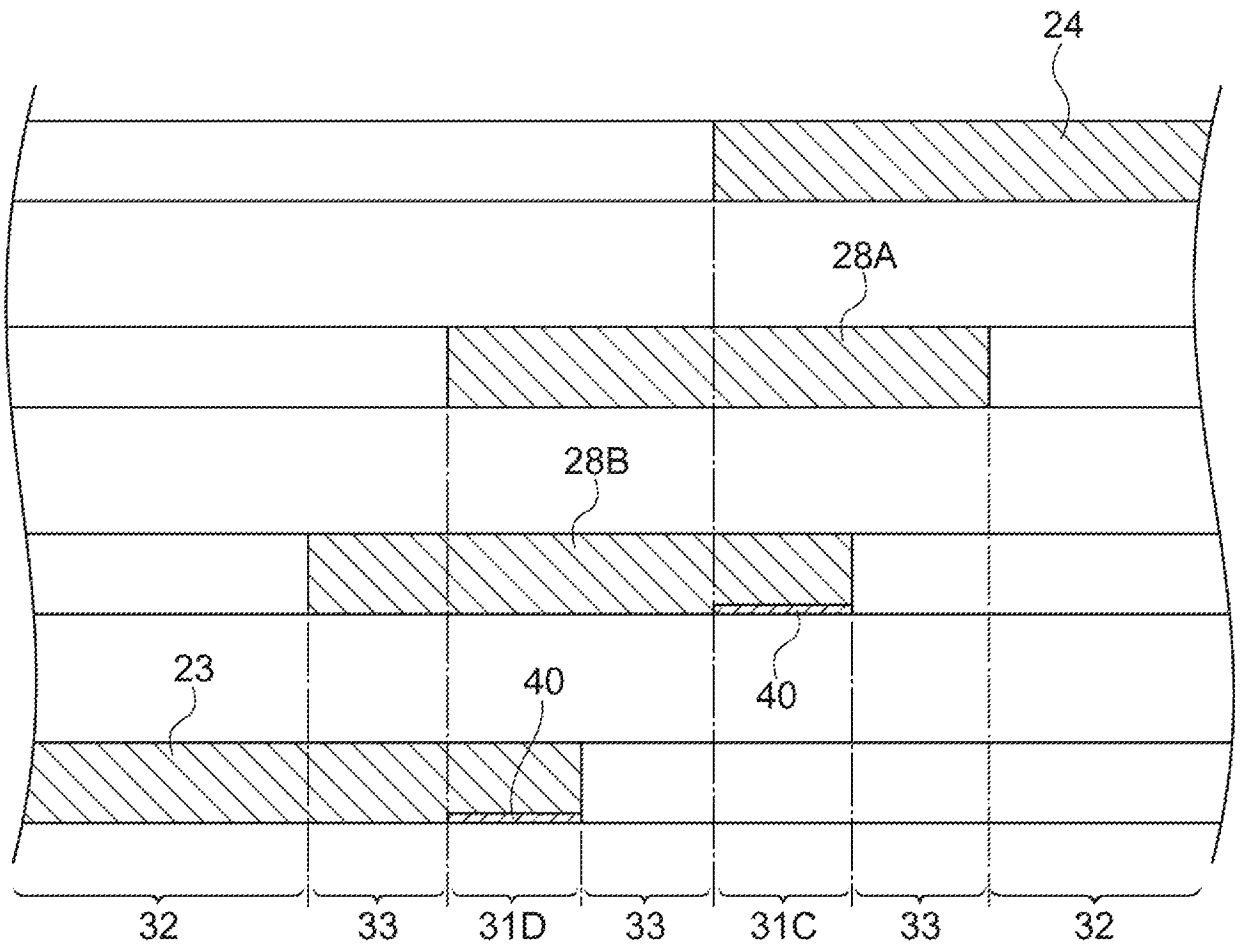
FIG. 9 is a diagram illustrating a multilayer coil component of another aspect.

For example, in the stepwise structure of the coil part, instead of the aspect where the coil conductive parts 22 are connected by one connecting part like the above-mentioned embodiment, an aspect may be employed in which the coil conductive parts 22 are connected by a plurality of connecting parts. FIG. 9 illustrates an aspect in which the coil conductive parts 22 are connected by two connecting parts (first connecting part 28A and second connecting part 28B). In the stepwise structure illustrated in FIG. 9, a maximum film thickness portion 31C is formed having a three-layers structure in which the lower coil part 24, the first connecting part 28A, and the second connecting part 28B are overlapped. A maximum film thickness portion 31D is also formed having a three-layers structure in which the first connecting part 28A, the second connecting part 28B, and the upper coil part 23 are overlapped. A middle film thickness portion 33 having a two-layers structure is also formed on the both ends of the maximum film thickness portions 31C, 31D so as to be adjacent to each other in the X direction. Furthermore, on both ends of the middle film thickness portion 33, the minimum film thickness portion 32 having a one-layer structure of the upper coil part 23 or the lower coil part 24 is formed so as to be adjacent to each other in the X direction. In this case, for example, by selectively or preferentially providing the stress relaxation part 40 on a part whose film thickness is thicker (e.g., the maximum film thickness portion 31C, 31D), inner stress in the stepwise structure can be relaxed to prevent occurrence of the crack C1 like the above-described embodiment.

Alternatively, the stress relaxation part need not necessarily be provided on the lower surface of the coil part, and may be provided on the upper surface. Alternatively, the stress relaxation part may be provided on both the lower surface and the upper surface of the coil part.

What is claimed is:

1. A multilayer coil component having a laminated structure and comprising:

a coil in an insulating element body, the coil having a stepwise structure with a plurality of coil parts adjacent to each other in a laminated direction being overlapped with each other in a stepwise manner in the stepwise structure;

the plurality of coil parts being disposed in a plurality of layers that form the laminated structure, each of the plurality of coil parts in the stepwise structure extending perpendicular to the laminated direction;

a first portion and a second portion in the stepwise structure, two or more of the coil parts being overlapped as layers in the first portion, the second portion having portions adjacent to the first portion in a direction perpendicular to the laminated direction, the second portion having a number of layers smaller than a number of the layers of the first portion;

a stress relaxation part that does not electrically connect the plurality of coil parts and is not composed of a conductive material, the stress relaxation part being overlapped with at least the first portion among the first portion and the second portion; and another first portion, two or more of the coil parts being overlapped as layers in the other first portion, the second portion having portions adjacent to at least one of the first portions in a direction perpendicular to the laminated direction, the second portion having a number of layers smaller than a number of the layers of the first portions, the two first portions not overlapping in the laminated direction, wherein the stress relaxation part is overlapped with at least the first portions among the first portions and the second portion.

2. The multilayer coil component according to claim 1, wherein the stress relaxation part overlaps only with the first portion among the first portion and the second portion.

3. The multilayer coil component according to claim 1, wherein the coil has a plurality of turns, and the stress relaxation part is provided on only one of a pair of the turns adjacent to each other in the laminated direction.

4. The multilayer coil component according to claim 2, wherein the coil has a plurality of turns, and the stress relaxation part is provided on only one of a pair of the turns adjacent to each other in the laminated direction.

* * * * *